US007618294B1

(12) United States Patent
Lin et al.

(10) Patent No.: US 7,618,294 B1
(45) Date of Patent: Nov. 17, 2009

(54) AUDIO PLUG CONNECTOR

(75) Inventors: Ming-Han Lin, Taipei Hsien (TW); Te-Hung Yin, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/260,927

(22) Filed: Oct. 29, 2008

(51) Int. Cl.
*H01R 24/04* (2006.01)

(52) U.S. Cl. ..... 439/669; 200/51 R

(58) Field of Classification Search ..... 439/668, 439/669; 200/51 R, 51.03, 51.04, 51.05, 200/51.06
See application file for complete search history.

(56) References Cited

U.S. PATENT DOCUMENTS 1,526,265 A * 2/1925 Bergman ..... 439/669
4,275,946 A * 6/1981 Manina et al. ..... 439/188
4,275,947 A * 6/1981 Takagi ..... 439/188
4,593,162 A * 6/1986 Rochette ..... 200/51.09
6,143,995 A * 11/2000 Ward ..... 200/51.05
6,319,030 B1 * 11/2001 Wu ..... 439/188
6,979,231 B2 * 12/2005 Shinohara ..... 439/669
7,196,293 B2 * 3/2007 Britto ..... 219/441
7,294,022 B1 * 11/2007 Cheng ..... 439/668
2005/0064764 A1 * 3/2005 Shinohara ..... 439/669
2007/0155249 A1 * 7/2007 Cheng ..... 439/668
2009/0197474 A1 * 8/2009 Wei et al. ..... 439/669

* cited by examiner

*Primary Examiner*—Ross N Gushi
(74) *Attorney, Agent, or Firm*—WPAT, P.C.; Anthony King

(57) ABSTRACT

An audio plug connector includes a contact module, a plug, and a switch module. The contact module includes a shell, a first contact terminal and a second contact terminal both received in the shell. The plug disposed in the shell has a mating portion, a first contact portion and a second contact portion. The mating portion extends out of the shell. The first contact portion and the second contact portion are received in the shell and respectively contact the first contact terminal and the second contact terminal. The switch module includes a shaft and a switch terminal held in one end of the shaft. The end of the shaft holding the switch terminal is rotatably received in the shell. The switch terminal is selectively connected with the first contact terminal and the second contact terminal under the rotation of the shaft.

12 Claims, 4 Drawing Sheets

AUDIO PLUG CONNECTOR

BACKGROUND OF THE INVENTION

1. Field of the Invention

The present invention generally relates to a connector, and more particularly to an audio plug connector.

2. The Related Art

A conventional audio plug connector is a standardized three-contact plug. The audio plug connector usually includes a sleeve, a ring, and a terminating tip. The audio plug connector is connected with a headset cable. Such headsets include a speaker for audio output and a microphone for audio input. The headset cable is typically terminated by the standardized three-contact audio plug connector, for example, the microphone wired to the tip, the speaker wired to the ring, and a headset ground wired to the sleeve of the audio plug connector. The audio plug connector is inserted into a complement audio jack connector which includes internal contacts to selectively contact the sleeve, ring, and tip of the audio plug connector to transmit audio signals.

However, sometimes the microphone function is not required for users, but the microphone is always electrically connected with the audio jack connector when the audio plug connector is electrically connected with the audio jack connector. In order to make the microphone inactive, the audio plug connector has to be pushed out of the audio jack connector, which also makes the speaker inactive. It is inconvenient for the users.

SUMMARY OF THE INVENTION

An object of the present invention is to provide an audio plug connector adapted for mating with an audio jack connector. The audio plug connector includes a contact module, a plug, and a switch module. The contact module includes a shell, a first contact terminal and a second contact terminal both received in the shell. The plug disposed in the shell has a mating portion, a first contact portion and a second contact portion. The mating portion extends out of the shell. The first contact portion and the second contact portion are received in the shell and respectively contact the first contact terminal and the second contact terminal. The switch module includes a shaft and a switch terminal held in one end of the shaft. The end of the shaft holding the switch terminal is rotatably received in the shell. The switch terminal is selectively connected with the first contact terminal and the second contact terminal under the rotation of the shaft.

As described above, the audio plug connector provides the switch terminal to be selectively connected with the first contact terminal and the second contact terminal, which makes the audio plug connector inactive or in operation. So the audio plug connector can be inactive without being pushed out from the audio jack connector. The audio plug connector according to the present invention is convenient for users.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
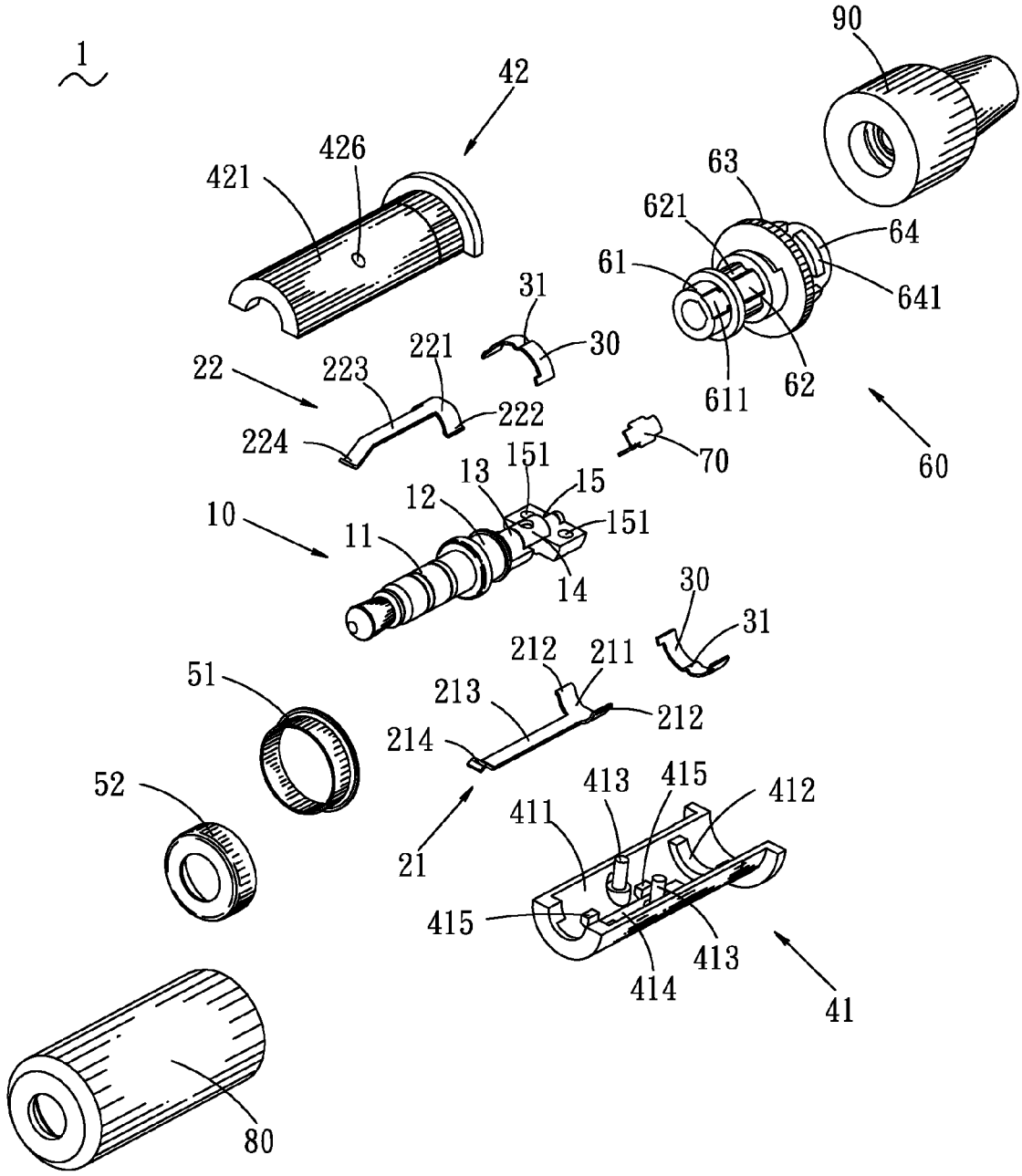
FIG. 1 is an exploded view of an audio plug connector in accordance with the present invention.

With reference to FIG. 1, an audio plug connector 1 according to the present invention includes a plug 10, a contact module, a switch module, a shield 80, and a tail 90.

The plug 10 is of a substantially cylindrical shape and includes a mating portion 11, a first contact portion 12, a second contact portion 13, and an extending portion 14 which are disposed in turn along an axis of the plug 10. A holding board 15 extends rearward from the extending portion 14. Two first holding holes 151 are formed in the holding board 15.

Please refer to FIG. 1 again, the contact module includes a set of contact terminals, two positioning pieces 30, a shell, a ring 51, and a cap 52.

The set of contact terminals includes a first contact terminal 21 and a second contact terminal 22. The first contact terminal 21 has an arc-shaped first holding piece 211. Two ends of the first holding piece 211 are respectively bent outward to form a first tab 212. The middle of one side of the first holding piece 211 extends forward to form a straight first connecting portion 213. A free end of the first connecting portion 213 is bent to form a first contact point 214. The second contact terminal 22 is shorter than the first contact terminal 21 and is substantially the same as the first contact terminal 21. The second contact terminal 22 includes a second holding piece 221, a second tab 222, a second connecting portion 223, and a second contact point 224.

The positioning piece 30 is an arc-shaped sheet. The middle of the positioning piece 30 is bent inward to form a retaining portion 31. The ring 51 and the cap 52 are cylinder-shaped.

The shell includes a first shell 41 and a second shell 42. The first shell 41 has a first basic portion 411 of a hemi-cylinder shape. An arc-shaped first protrusion 412 is protruded from an inner surface of the first basic portion 411. Two first rods 413 are abreast protruded from a middle portion of the inner surface of the first basic portion 411. An elongated first projection 414 is protruded from the inner surface of the first basic portion 411 along an axis direction of the first shell 41. Two ends of two opposite sides of the first projection 414 are protruded to form a plurality of first bumps 415.

Figure 2:
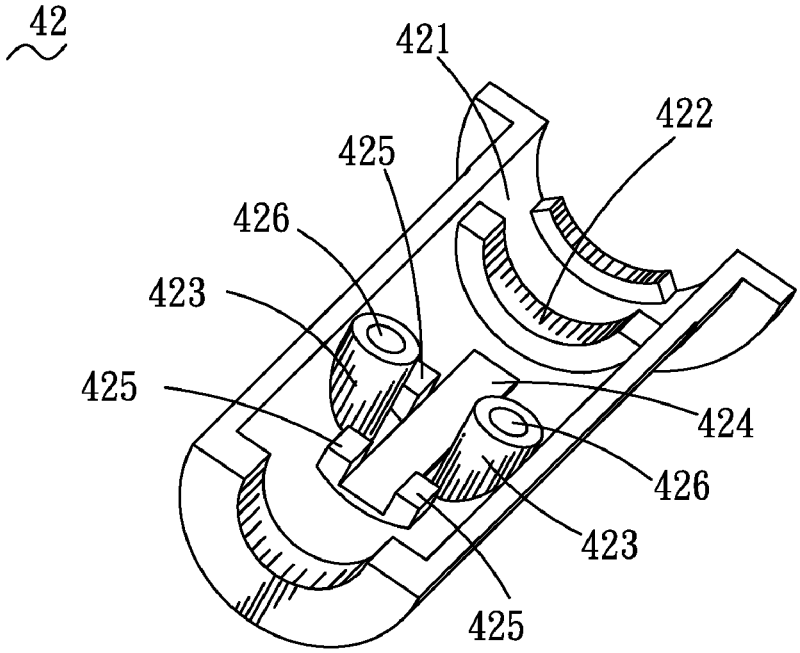
FIG. 2 is a perspective view of a second shell of the audio plug connector shown in FIG. 1.

Please refer to FIGS. 1 and 2, the second shell 42 is similar to the first shell 41. The second shell 42 has a second basic portion 421, a second protrusion 422, two second rods 423, a second projection 424, and a plurality of bumps 425 which are the same as the first shell 41. The difference between the first shell 41 and the second shell 42 is that each of the second rods 423 defines a second holding hole 426 passing through the second rod 423 and an outer surface of the second basic portion 421.

Please refer to FIG. 1 again, the switch module includes a shaft 60 and a switch terminal 70 installed in the shaft 60.

The shaft 60 has a cylindrical contact loop 61. A fixing groove 611 is formed in an outer surface of the contact loop 61 extending along an axis direction of the contact loop 61. A positioning loop 62 extends rearward from a rear end of the contact loop 61. A plurality of positioning slots 621 is equidistantly defined in an outer surface of the position loop 62 and extends along an axis direction of the positioning loop 62. A rear end of the positioning loop 62 extends outward to form a retaining piece 63. A drive portion 64 extends rearward from the retaining piece 63 and a plurality of fixing pieces 641 equidistantly extends outward from an outer surface of the drive portion 64. A shaft hole (not labeled) passes through the shaft 60.

Figure 3:
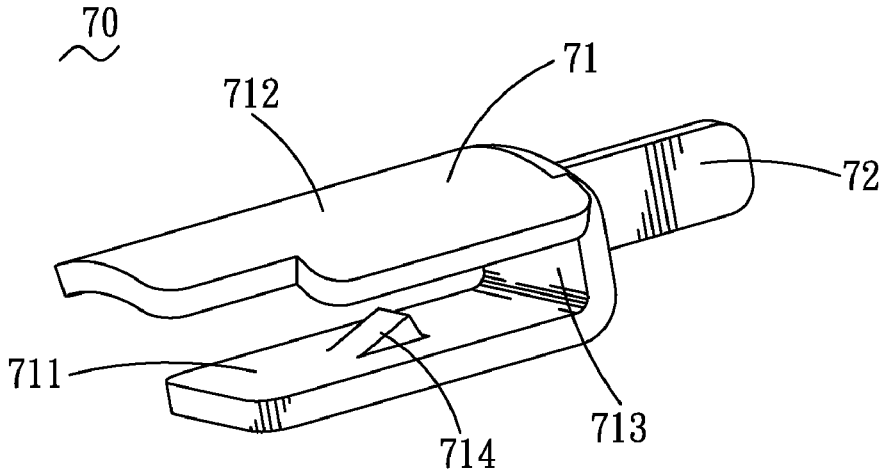
FIG. 3 is a perspective view of a switch terminal of the audio plug connector shown in FIG. 1.
Figure 4:
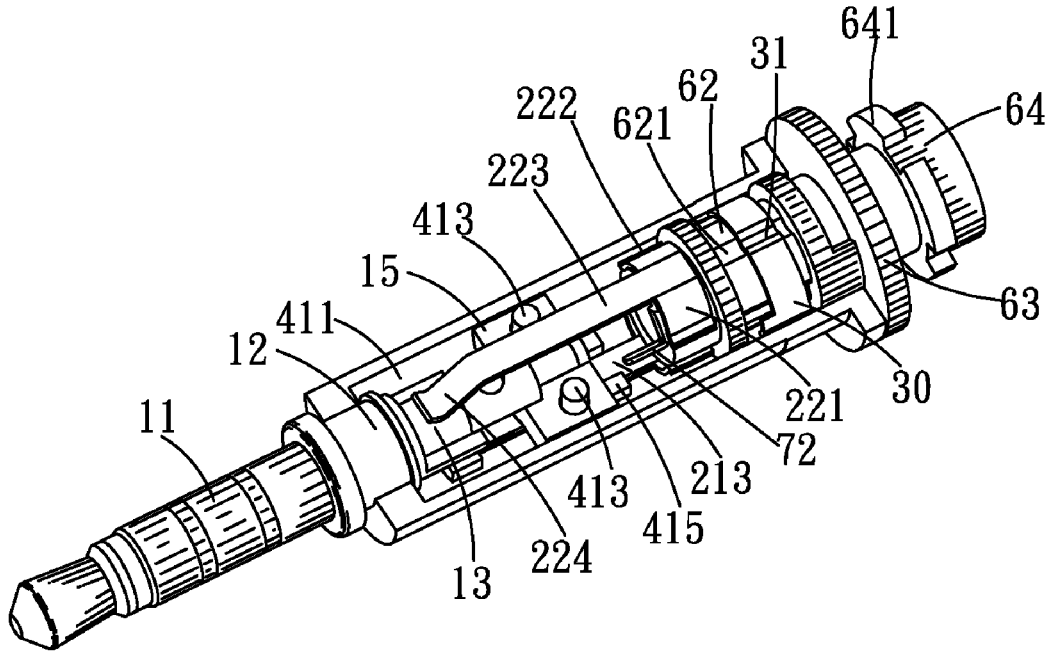
FIG. 4 is a perspective view of the audio plug connector shown in FIG. 1 after removing the second shell, a ring, a cap, a shield, and a tail.
Figure 5:
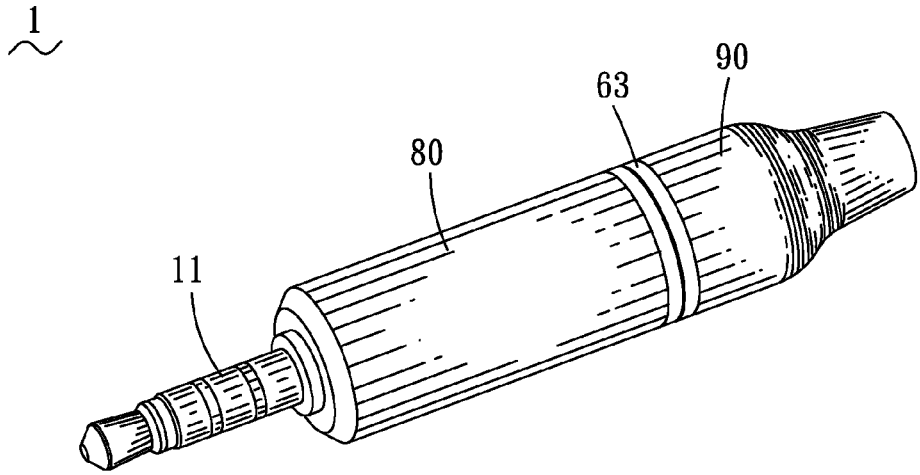
FIG. 5 is a perspective view of the audio plug connector shown in FIG. 1.
Figure 6:
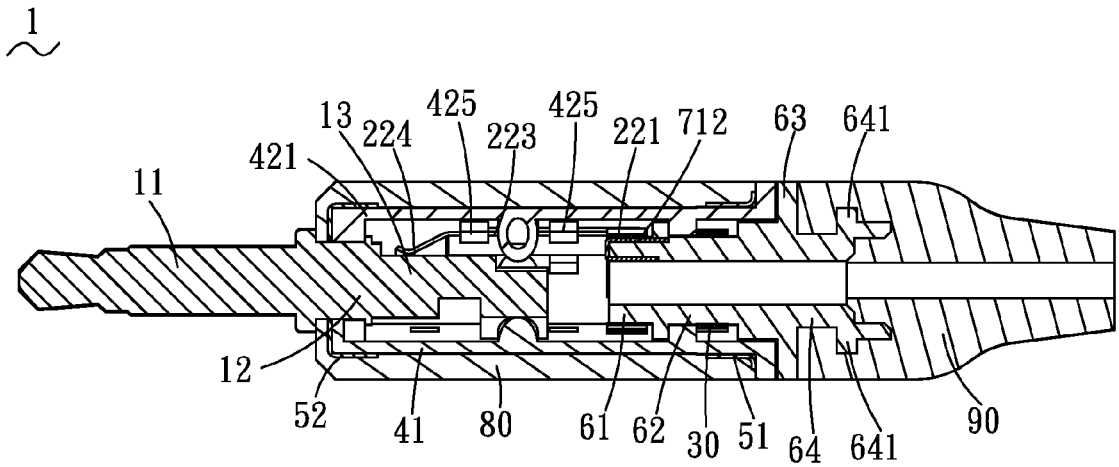
FIG. 6 is a cross-section view of the audio plug connector shown in FIG. 1 when the switch terminal is connected with a second contact terminal.

With referring to FIGS. 1 and 3, the switch terminal 70 has a substantially U-shaped clipping portion 71. The clipping portion 71 includes a flat clipping piece 711, an arc-shaped contact piece 712 superposed with and spaced from the clipping piece 711, and a connecting piece 713 connected with one end of the clipping piece 711 and the contact piece 712. A center portion of the clipping piece 711 is punched inwardly to form a bulge 714. A soldering piece 72 extends outward from one side of the connecting piece 713. The clipping portion 71 of the switch terminal 70 is clipped on the contact loop 61 of the shaft 60. More specially, the contact piece 712 is received in the fixing groove 611 and the clipping piece 711 contacts an inner surface of the contact loop 61. The bulge 714 of the clipping piece 711 is embedded into the inner surface of the contact loop 61.

Please refer to FIGS. 1, 4, 5 and 6, the first contact terminal 21 and the second contact terminal 22 are respectively held in the first shell 41 and the second shell 42. More specially, the first holding piece 211 and the second holding piece 221 are respectively supported by the first protrusion 412 of the first shell 41 and the second protrusion 422 of the second shell 42. The first connecting portion 213 and the second connecting portion 223 are respectively supported by the first projection 414 and the second projection 424 and held by the first bumps 415 and the second bumps 425. The first holding holes 151 of the holding board 15 of the plug 10 are respectively mated with the first rods 413 of the first shell 41. The two positioning pieces 30 are respectively fixed in the inner surface of the first shell 41 and the second shell 42 and adjacent to the first protrusion 412 and the second protrusion 422.

The shaft 60 assembled with the switch terminal 70 is installed in the first shell 41. The retaining piece 63 is retained by the end of the first shell 41 adjacent to the first protrusion 412. The contact loop 61 is supported by the first holding piece 211 and the positioning loop 62 is supported by the positioning pieces 30.

The second shell 42 is engaged with the first shell 41. The first rods 413 are respectively inserted into the second holding holes 426. The first contact portion 12, the second contact portion 13 and the extending portion 14 of the plug 10, the first contact terminal 21, the second contact terminal 22, the positioning pieces 30, the switch terminal 70, the contact loop 61 and the positioning loop 62 of the shaft 60 are surrounded in the space inside the first shell 41 and the second shell 42. The first holding piece 211 and the second holding piece 221 are placed on the outside of the contact loop 61 and spaced from each other. The positioning loop 62 is surrounded by the two position pieces 30. The retaining portions 31 of the two positioning piece 30 are respectively received in the opposite positioning slots 621 of the positioning loop 62. The first contact point 214 of the first contact terminal 21 and the second contact point 224 of the second contact terminal 22 respectively contact the first contact portion 12 and the second contact portion 13 of the plug 10. The ring 51 encircles the first shell 41 and the second shell 42 at the end away from the plug 10. The cap 52 encircles the first shell 41 and the second shell 42 at the end adjacent to the plug 10. The first shell 41 and the second shell 42 are fastened together firmly by the ring 51 and the cap 52.

The shield 80 is substantially cylinder-shaped and surrounds the first shell 41 and the second shell 42. The mating portion 11 of the plug 10 extends out of the shield 80 through one end of the shield 80. The drive portion 64 is inserted into the tail 90 and a front end of the tail 90 is restrained by the retaining piece 63. The fixing piece 641 of the drive portion 64 is fixed in an inner surface of the tail 90 to prevent the shaft 60 being relative moved to the tail 90.

A headset (not shown) includes a microphone for audio input and a speaker for audio output. A headset cable (not shown) has two signal wires connected with the microphone, two signal wires connected with the speaker, and a grounding wire. The cable passes through the tail 90 and the shaft hole of the shaft 60 to make that the two signal wires connected with the microphone are respectively soldered to the second contact portion 13 of the plug 10 and the soldering piece 72 of the switch terminal 70, the two signal wires connected with the speaker are soldered to the plug 10, and the grounding wire is soldered to the first connecting portion 213 of the first contact terminal 21.

In use, the audio plug connector 1 is adapted for inserting into a complement audio jack connector (not shown). A user rotates the tail 90 to make the shaft 60 rotate relatively to the first shell 41 and the second shell 42. The switch terminal 70 fixed in the shaft 60 rotates with the rotation of the shaft 60. When the retaining portion 31 of each positioning piece 30 is sliding in adjacent positioning slot 621, the rotation is stopped. The contact piece 712 of the switch terminal 70 contacts the first holding piece 211 or the second holding piece 221. The switch terminal 70 is connected with one of the two signal wires connected with the microphone, the first contact terminal 21 and second contact portion 13 are respectively connected with the grounding wire and the other one of the two signal wires. So when the switch terminal 70 contacts the first holding portion 211 of the first contact terminal 21 which is connected with the grounding wire, the microphone is inactive. When the switch terminal 70 contacts the second holding portion 221 which is electrically connected with the microphone, the microphone is in operation. The speaker which is connected with the plug 10 is always in operation when the audio plug connector 1 is electrically connected with the audio jack connector.

As described above, the audio plug connector 1 according to the present invention provides the switch terminal 70 to be selectively connected with the first contact terminal 21 and the second contact terminal 22, which can control whether the microphone is in operation. So the audio plug connector 1 is easy to make the microphone cut off yet the speaker is still in operation.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio plug connector, comprising:

a contact module having a shell, a first contact terminal and a second contact terminal both received in the shell;

a plug disposed in the shell having a mating portion, a first contact portion and a second contact portion, the mating portion extending out of the shell, the first contact portion and the second contact portion received in the shell and respectively contacting the first contact terminal and the second contact terminal; and a switch module having a shaft and a switch terminal held in one end of the shaft, the end of the shaft holding the switch terminal rotatably received in the shell, the switch terminal being selectively connected with the first contact terminal and the second contact terminal under the rotation of the shaft.

2. The audio plug connector as claimed in claim 1, wherein the end of the shaft rotatably received in the shell has a contact loop, the switch terminal has a contact piece fixedly attached on an outside of the contact loop.

3. The audio plug connector as claimed in claim 2, wherein the switch terminal has a substantially U-shaped clipping portion clipping in the contact loop, the clipping portion has a clipping piece and the contact piece superposed with and spaced from the clipping piece, the clipping piece is attached on an inner surface of the contact loop, the contact piece is attached on the outside of the contact loop.

4. The audio plug connector as claimed in claim 2, wherein the outside of the contact loop defines a fixing groove, the contact piece is fixed in the fixing groove of the contact loop.

5. The audio plug connector as claimed in claim 2, wherein the first contact terminal and the second contact terminal respectively have an arc-shaped first holding piece and an arc-shaped second holding piece, the first holding piece and the second holding piece are placed on the outside of the contact loop and spaced from each other, the switch terminal selectively contact the first holding piece and the second holding piece.

6. The audio plug connector as claimed in claim 5, wherein one side of the first holding piece and the second holding piece respectively extend outward to form a first connecting portion and a second connecting portion, free ends of the first connecting portion and the second connecting portion are respectively bent to form a first contact point and a second contact point, the first contact point and the second contact point are respectively connected with the first contact portion and the second contact portion of the plug.

7. The audio plug connector as claimed in claim 6, wherein the shell includes a first shell and a second shell engaged with the first shell, the first shell and the second shell respectively have a hemi-cylinder shaped first basic portion and a hemi-cylinder shaped second basic portion, a first protrusion and a second protrusion are respectively protruded from the inner surfaces of the first basic portion and the second basic portion, the first holding piece of the first contact terminal and the second holding piece of the second contact terminal are respectively supported by the first protrusion and the second protrusion, a plurality of first bumps and a plurality of second bumps are respectively protruded from the inner surfaces of the first basic portion and the second basic portion for respectively holding the first connecting portion of the first contact terminal and the second connecting portion of the second contact terminal therebetween.

8. The audio plug connector as claimed in claim 7, wherein the plug further includes a holding board with a plurality of first holding holes therein, the inner surfaces of the first basic portion and the second basic portion respectively extend to form a plurality of first rods and a plurality of second rods, each of the second rods defines a second holding hole therein, the first rod passes through the first holding hole of the holding board and is inserted into the second holding hole of the second rod.

9. The audio plug connector as claimed in claim 1, further comprising a plurality of arc-shaped positioning pieces disposed in one end of the shell, the middle of each of the positioning pieces is dented to form a retaining portion.

10. The audio plug connector as claimed in claim 9, wherein the shaft further includes a positioning loop, a plurality of positioning slots are formed in an outer surface of the positioning loop along an axis direction of the shaft, the positioning pieces surround the positioning loop and the retaining portions of the positioning pieces are received in the positioning slots of the positioning loop.

11. The audio plug connector as claimed in claim 1, wherein the shaft has a drive portion disposed opposite to the contact loop, a plurality of fixing pieces are protruded from an outer surface of the drive portion.

12. The audio plug connector as claimed in claim 11, further comprising a tail mated with the drive portion of the shaft, the fixing pieces fixed in an inner surface of the tail.

* * * * *